US005402761A

United States Patent [19]

Dechellis

[11] Patent Number: 5,402,761

[45] Date of Patent: Apr. 4, 1995

[54] ENGINE TIMING PLATE

[76] Inventor: Anthony Dechellis, 1725 Monrovia #B-4, Costa Mesa, Calif. 92627

[21] Appl. No.: 152,226

[22] Filed: Nov. 12, 1993

[51] Int. Cl.[6] ..... F02P 5/155; F02P 7/067

[52] U.S. Cl. ..... 123/414; 123/146.5 A

[58] Field of Search ..... 123/146.5 A, 414, 612, 123/613, 617, 476

[56] References Cited

U.S. PATENT DOCUMENTS

| | | | |
|---|---|---|---|
| 3,660,623 | 5/1972 | Bevacqua | 200/19 R |
| 3,906,920 | 9/1975 | Hemphill | 123/146.5 A |
| 3,971,350 | 7/1976 | Hays | 123/414 |
| 4,058,691 | 11/1977 | Wittner | 200/31 R |
| 4,177,781 | 12/1979 | Marchelletta et al. | 123/146.5 A |
| 4,409,585 | 10/1983 | Rousseau | 123/146.5 A |
| 4,485,796 | 12/1984 | Boyer | 123/146.5 A |
| 4,744,339 | 5/1988 | Nagai et al. | 123/146.5 A |
| 4,951,629 | 8/1990 | McAbee et al. | 123/414 |
| 4,972,818 | 11/1990 | Nomura et al. | 123/414 |
| 5,131,366 | 7/1992 | Rawlings et al. | 123/414 |

*Primary Examiner*—Willis R. Wolfe

*Attorney, Agent, or Firm*—Hawes & Fischer

[57] ABSTRACT

An engine timing plate for cooperating with an engine driven timing wheel and an inductive sensor is provided. An arcuate plate is formed to fit internally within an ignition system housing. The plate includes at least two separate slots positioned on an arc such that the plate is movable, relative to two mounting screws of the housing, over a selected angular range for adjusting engine timing. A sensor mount is included for engaging the inductive sensor in a position adjacent to the timing wheel. An elongate window in the plate is positioned for exposing a timing line that is visible on a mounting surface of the housing. The window provides visual guidance with respect to the timing line in positioning the inductive sensor. The elongate window may provide a series of reference lines for more accurately aligning the plate through relative positioning of the timing line with the series of reference lines. As such, the inductive sensor may be readily positioned over the selected angular range along the outside arc of the timing wheel for modifying engine timing.

8 Claims, 2 Drawing Sheets

ENGINE TIMING PLATE

FIELD OF THE INVENTION

This invention relates generally to engine ignition timing systems and, more particularly, is directed towards an easily adjusted timing plate for mounting of an inductive sensor within such an ignition timing system.

BACKGROUND OF THE INVENTION

Proper engine timing—that is, the timing of the spark relative to the position of the piston within each cylinder—is important for proper engine performance. Engine performance can be modified significantly by slighting changing the timing of the spark. As such, it is desirable to be able to finely adjust the engine timing.

Various engine-timing plates are known in the prior art. As it is convenient to modify the ignition timing of the spark at the distributor assembly, most such timing plates are designed for installation at the distributor. For example, U.S. Pat. No. 4,744,339 to Nagai et al. on May 17, 1988, illustrates such a device (FIG. 7), as does U.S. Pat. No. 4,177,781 to Marchelletta et al. on Dec. 11, 1979; U.S. Pat. No. 4,058,691 to Wittner on Nov. 15, 1977; U.S. Pat. No. 3,906,920 to Hemphill on Sep. 23, 1975; and U.S. Pat. No. 3,660,623 to Bevacqua on May 2, 1972. All of these prior art devices illustrate adjustable timing plates for various types of distributor assemblies. Typical of such devices is a slotted mounting hole that permits limited movement along an arc for adjusting the timing of the spark relative to a rotor member.

A considerable drawback to all such prior art timing plates is that there is no means of referencing the location of the plate to the distributor assembly. As a result, if the timing plate over time becomes shifted from its original position, such shifting is difficult to detect with the eye. Further, with no referencing means between the timing plate and the distributor assembly, it is difficult to know by how much to adjust the timing plate to advance or retard the timing of the spark by a given amount. As a result, such timing plates of the prior art are difficult to adjust accurately and in a trial-and-error type of manner. The present invention fulfills these needs and provides further related advantages.

SUMMARY OF THE INVENTION

The present invention is an engine timing plate for cooperating with an engine driven timing wheel and an inductive sensor. An arcuate plate is formed to fit internally in an ignition timing housing. The plate includes at least two separate slots positioned on an arc such that the plate is movable, relative to two mounting screws in the housing, over a selected angular range for adjusting engine timing. A sensor mount is included for engaging the inductive sensor in a position adjacent to the timing wheel. An elongate window in the plate is positioned for exposing a timing line that is visible on a mounting surface of the housing. The window provides visual guidance with respect to the timing line in positioning the inductive sensor. The elongate window may provide a series of reference lines for more accurately aligning the plate through relative positioning of the timing line with the series of reference lines. As such, the inductive sensor may be readily positioned over the selected angular range along-the outside arc of the timing wheel for modifying engine timing.

Clearly, then, there is a need for a timing plate that is easily adjusted within a conventional ignition timing assembly and that provides improved referencing means for accurately positioning the timing plate relative to the ignition timing housing. Such a needed invention would be relatively simple to manufacture. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
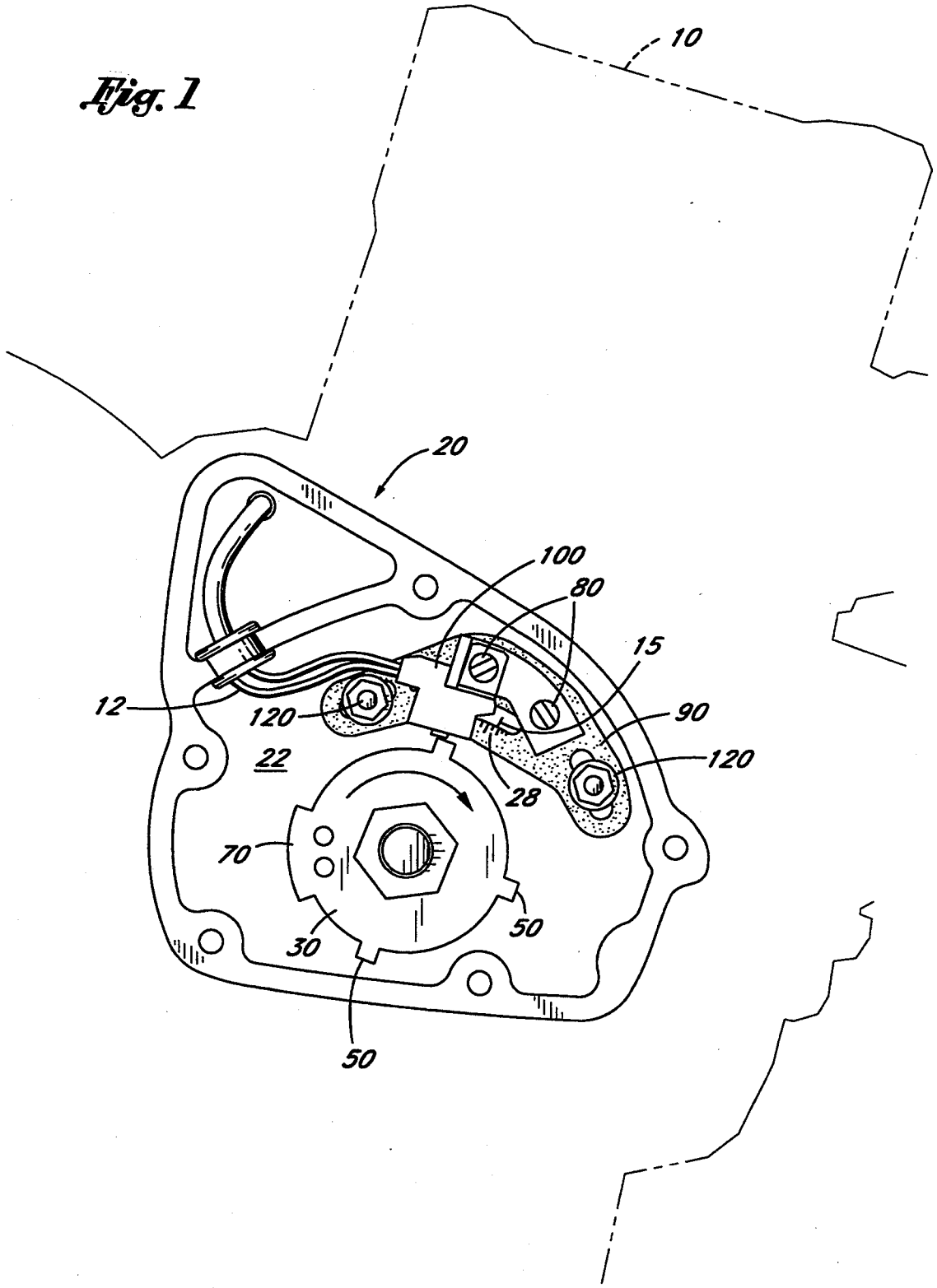
FIG. 1 is a front elevational view of the invention, illustrating an arcuate plate of the invention as mounted on an engine case, the engine being shown in phantom outline.
Figure 3:
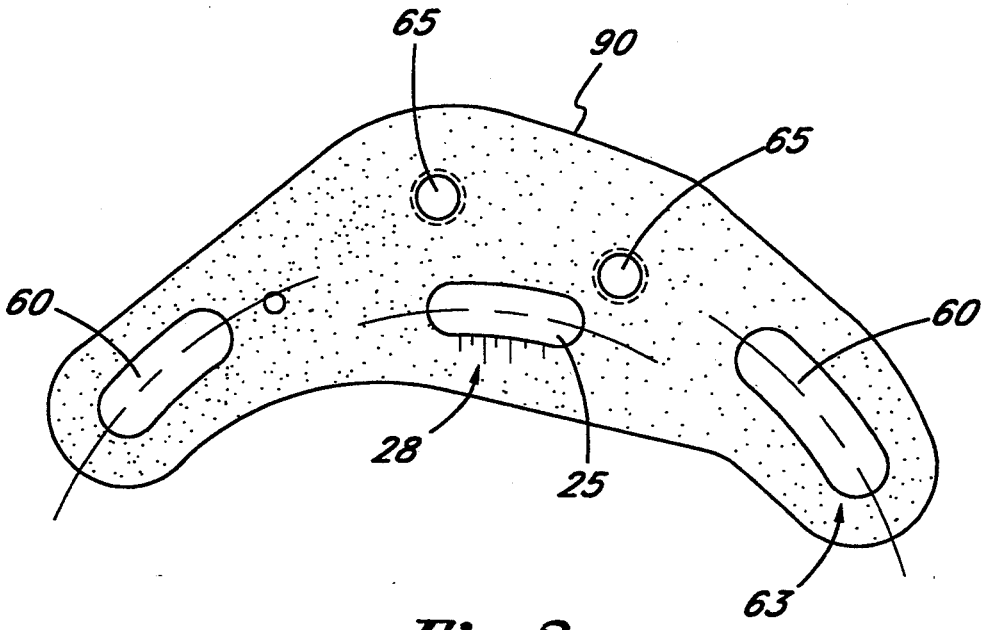
FIG. 3 is a front elevational view of the invention, illustrating the arcuate plate of the invention with an elongate window and a series of reference lines of the invention.

FIGS. 1 and 3 show an engine timing plate 90 for providing an adjustable mounting for an inductive sensor 100 that cooperates with an engine driven timing wheel 30. The arcuate timing plate 90 is shaped to fit internally in an engine case or housing 20 against a mounting surface 22 of the housing 20. Preferably, the plate 90 is formed from a rigid sheet material with a melting point above 250° F. so as to withstand normal engine operating temperatures.

The plate 90 includes slotted mounting means 63 for adjustably fixing the plate 90 at a selected angular position with respect to the timing wheel 30. The slotted mounting means 63 includes at least two separate slots 60 in the plate 90 positioned on circular arcs such that the plate 90 is movable, relative to two mounting fasteners 120 fastened to the mounting surface 22, over a selected angular range for adjusting engine timing. In order to assure precise positioning of the sensor 100, the width of the slots 60 hold a close tolerance to the fasteners 120. A sensor mounting means 65 is included for mounting the inductive sensor 100 on the timing plate in a position adjacent to the timing wheel 30 (FIG. 1), and is preferably a pair of tapped mounting holes for receiving a pair of sensor mounting 80.

An elongate arcuate window 25 in the plate 90 is positioned for exposing a timing line 15 that is fixed to, and visible on, the second mounting surface 22. The window 25 provides visual guidance with respect to the timing line 15 in positioning the inductive sensor 100. Preferably, the plate 90 provides a series of reference lines 28 arranged adjacent to the window 25 for more accurately aligning the plate 90 through relative positioning of the timing line 15 with the series of reference lines 28. As such, the inductive sensor 100 may be easily positioned over the selected angular range in a position adjacent to the timing wheel 30 for modifying engine timing.

The timing wheel 30 provides lobes 50,70 extending from the wheel 30 which pass the inductive sensor 100 on each engine revolution. As a lobe 50,70 passes the sensor 100 it is sensed inductively so that a spark may be triggered for a corresponding spark plug via the electrical wires 12.

Figure 2:
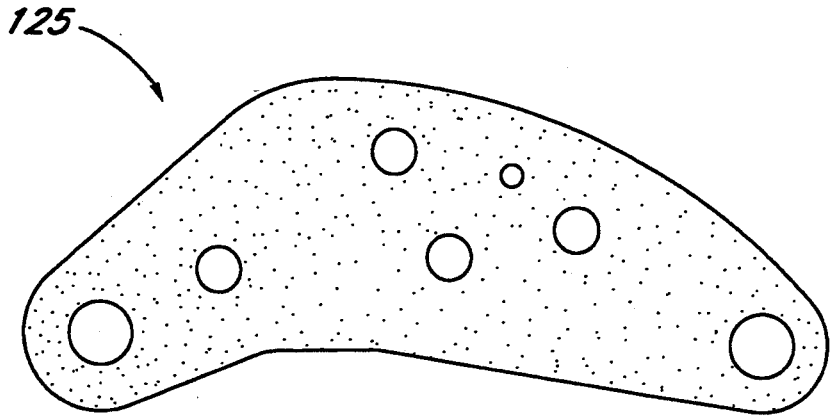
FIG. 2 is a front elevational view of a timing plate of the prior art.

FIG. 2 depicts a prior art mounting plate 125 which is used for merely holding the inductive sensor 100 in a well-defined, precise position on the mounting surface 22.

In use, the plate 90 is moved by loosening the fasteners 120. An appropriate position for advancing or retarding spark occurrence relative to cylinder position is selected by noting the position of the timing line 15, with respect to the reference lines 28. After the plate 90 is in a desired position, the two fasteners 120 are then tightened.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An engine timing plate for cooperating with an engine driven timing wheel and an inductive sensor, for an engine whose sole means of adjusting timing is a shift in position of said inductive sensor, comprising an arcuate plate adapted to fit within an ignition system housing against a mounting surface therein, and having a timing line indicating the degree of angular displacement of said plate for manual adjustment of said plate, the plate including slotted mounting means adapted for adjustably fixing the timing plate at a selected position on the mounting surface, and sensor mounting means for rigidly engaging said inductive sensor in a position adjacent to the timing wheel to adjust the position of the sensor upon adjustment of the plate with the use of said timing line for advancing and for alternately retarding the spark.

2. The engine timing plate for cooperating with an engine driven timing wheel and an inductive sensor of claim 1 wherein the slotted mounting means includes at least two separate slots in the plate.

3. The engine timing plate for cooperating with an engine driven timing wheel and an inductive sensor of claim 2 wherein the slots are arcuate in shape and arranged on circular arcs concentric with the timing wheel whereby plate adjustment is limited to arcuate movement.

4. An engine timing plate for cooperating with an engine driven timing wheel and an inductive sensor, comprising an arcuate plate adapted to fit within an ignition system housing against a mounting surface therein, the plate including slotted mounting means adapted for adjustably fixing the timing plate at a selected position on the mounting surface, and sensor mounting means for rigidly engaging said inductive sensor in a position adjacent to the timing wheel to adjust the position of the sensor for advancing and for alternately retarding the spark said arcuate plate having an elongated window positioned in the plate for exposing a timing line fixed on the mounting surface of the housing whereby the plate is positionable on the mounting surface by reference to the timing line as viewed through the window.

5. The engine timing plate for cooperating with an engine driven timing wheel and an inductive sensor of claim 4 further including a series of reference lines arranged in sequence adjacent to the window for accurately aligning the plate with the timing line.

6. The engine timing plate for cooperating with an engine driven timing wheel and an inductive sensor of claim 4 wherein the slotted mounting means includes at least two separate slots in the plate.

7. The engine timing plate for cooperating with an engine driven timing wheel and an inductive sensor of claim 5 wherein the slots are arcuate in shape and arranged on circular arcs concentric with the timing wheel whereby plate adjustment is limited to arcuate movement.

8. The engine timing plate for cooperating with an engine driven timing wheel and an inductive sensor of claim 4 wherein the window is arcuate shaped.

* * * * *